United States Patent [19]

Simpson-Davis

[11] Patent Number: 4,881,731

[45] Date of Patent: Nov. 21, 1989

[54] SHEET FEEDING APPARATUS

[75] Inventor: Raymond Simpson-Davis, Hampshire, England

[73] Assignee: De La Rue Systems, Ltd., England

[21] Appl. No.: 243,683

[22] Filed: Sep. 13, 1988

[30] Foreign Application Priority Data

Sep. 16, 1987 [GB] United Kingdom ..... 8721744

[51] Int. Cl.[4] ..... B65H 29/40

[52] U.S. Cl. ..... 271/315

[58] Field of Search ..... 271/187, 315, 307, 312

[56] References Cited

U.S. PATENT DOCUMENTS 4,501,418 2/1985 Ariga ..... 271/315 X 4,638,993 1/1987 Granzow ..... 271/187 X

*Primary Examiner*—Richard A. Schacher

*Attorney, Agent, or Firm*—Ostrolenk, Faber, Gerb & Soffen

[57] ABSTRACT

Apparatus for feeding sheets, particularly bank notes, comprises a feed system (1) for feeding sheets (6), and a sheet stacking system (7) to which the sheets are fed by the feed system (1), the sheet stacking system (7) including a rotatable stacking wheel (8) having a plurality of sheet receiving slots (9') into which sheets are fed by the sheet feed system (1), rotation of the stacking wheel (8) carrying sheets from a sheet receiving position (30) to a sheet stacking position (32), the sheet stacking system (7) including means (16) actuable to stop rotation of the sheet stacking system (7) to enable at least the leading end of a sheet to be fed into a sheet receiving slot of the stacking wheel (8). Typically, the means actuable to stop rotation of the stacking wheel (8) includes a hub brake (16) and a slipping clutch mechanism (11,13,14) to enable a drive means (5) to continue to operate when the stacking wheel (8) is stopped.

5 Claims, 2 Drawing Sheets

SHEET FEEDING APPARATUS

FIELD OF THE INVENTION

This invention relates to sheet feeding apparatus and in particular apparatus for feeding documents such as bank notes.

DESCRIPTION OF THE PRIOR ART

In conventional bank note sorting apparatus it is usually necessary to stack the bank notes at some point during the sorting process. An example of this is in cash dispensing machines where bank notes are stacked prior to being dispensed from the machine. In order to perform the stacking operation it is common practice to use one or a number of rotating stacking wheel with a number of tines between which single bank notes are placed. During rotation of the wheel the bank notes are stripped one by one from the tines and drop into a stacking position.

Synchronising the feeding of the bank notes to the tines of a conventional stacking wheel is a common problem in bank note sorting apparatus. For example the bank notes may hit the end of a tine instead of being inserted between two tines. A second problem is that if the bank note to be inserted between the tines lacks any inherent stiffness or has been prefolded prior to being inserted into the sorting apparatus then even if the leading end of the bank note is inserted between two tines if there is any lack of synchronisation there is a tendency for the note to fold into the next tine compartment as the stacking wheel rotates.

For example, International Patent Application No. WO84/02327 discloses a sheet feeding system having a conventional stacking wheel which suffers from these problems of synchronisation.

If any of these problems occur the stacking wheel and associated mechanisms may become jammed or the notes being fed may become torn or disfigured. In cash dispensing machines this could result in the notes not being dispensed to a customer.

One solution to the problems above has been suggested by International Patent Application No. WO83/00136. In this disclosure a slipping clutch and a brake are connected to the drive mechanism of the stacker wheel to enable the stacker wheel to be decelerated to obtain synchronisation of the insertion of a note between the tines of the stacker wheel. However, this method only prevents bank notes from hitting the ends of the tines and does not prevent bank notes from being folded into the next tine compartment.

SUMMARY OF THE INVENTION

In accordance with the present invention, sheet feeding apparatus comprises a feed system for feeding sheets and a sheet stacking system to which sheets are fed by the feed system, the sheet stacking system including a rotatable stacking wheel having a plurality of sheet receiving slots to which sheets are fed by the sheet feed system, rotation of the stacking wheel carrying sheets from a sheet receiving position to a sheet stacking position, the sheet stacking system including means actuable to stop the rotation of the sheet stacking system to enable at least the leading end of the sheet to be fed into a sheet receiving slot of the stacking wheel, drive means to rotate the stacking wheel, and a clutch connecting the drive means to the stacking wheel to enable the drive means to continue rotating when the stacking wheel is stopped, wherein the clutch comprises a drive belt entrained around first and second pulley wheels, the first pulley wheel being driven by the drive means and the second pulley wheel being connected to the sheet stacking wheel, the drive belt being adapted to slip around one or both of the pulley wheels when the rotation of the stacking wheel is stopped.

This invention deals with the problem associated with feeding sheets into a rotating sheet stacking wheel by providing means to stop rotation of the wheel while at least the leading end of the sheet is fed into one of the sheet receiving slots of the stacking wheel. The invention is particularly applicable for use in bank note or other document (particularly security documents) handling operations in which the sheets have to be stacked in a neat pile.

In some cases, rotation of the stacking wheel may be stopped until a complete sheet has been fed into a sheet receiving slot of the stacking wheel although in general stoppage for this length of time will not be necessry.

Enabling the drive means to continue to operate when the stacking wheel is stopped, by use of the clutch, reduces wear on the drive means. This is particularly suitable where a common drive means is provided for both the stacking system and the feed system so that the feed system can continue to operate even though the stacking wheel is being intermittently stopped.

Typically, rotation of the stacking wheel is stopped by a brake.

We have found, surprisingly, that belt slippage is sufficient to allow the stacking wheel to be completely stopped momentarily and, more surprisingly, that belt wear on a small plastic pulley wheel despite the relatively high linear speeds used is not detrimental to satisfactory operation.

Conveniently, the sheet stacking system further comprises stripper means cooperating with the stacking wheel to strip sheets from the sheet receiving slots during rotation of the stacking wheel to the sheet receiving position.

Although the invention has been described with the use of a single stacking wheel, in general a number of stacking wheels will be provided.

Preferably, the apparatus further comprises detectors which detect the presence of a sheet at the sheet receiving position and the positions of the sheet receiving slots, and a processing unit which generates a stacking wheel stop signal to stop rotation of the stacking wheel in such a position that a sheet may be fed into a sheet receiving slot from the feed system.

BRIEF DESCRIPTION OF THE DRAWINGS

An example of sheet feeding apparatus in accordance with the present invention will now be described with reference to the accompanying drawings, in which.

DETAILED DESCRIPTION OF THE DRAWINGS

Figure 1:
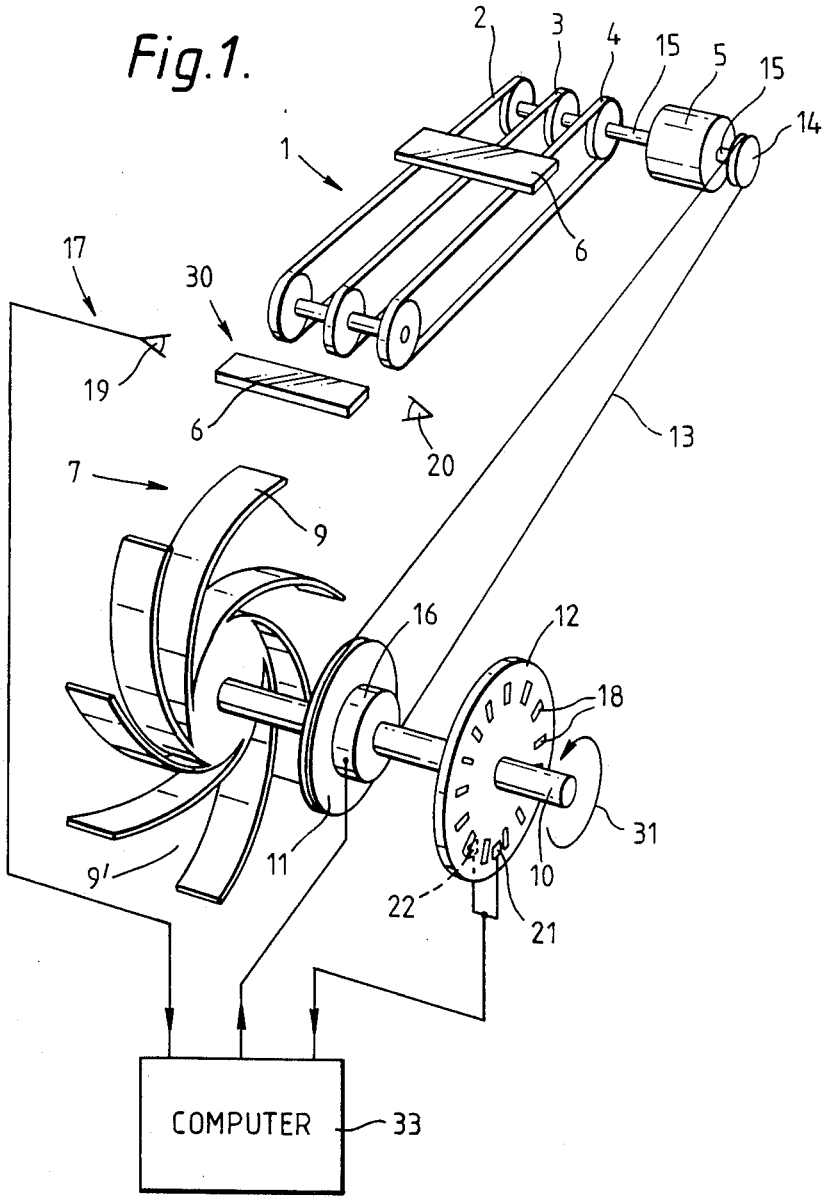
FIG. 1 is a schematic perspective view of an example of the apparatus with some parts omitted for clarity; and, FIG. 2 is a schematic end view of the sheet stacking system shown in FIG. 1.

The apparatus shown in FIG. 1 comprises a bank note transport mechanism 1 having a number of conveyor belts 2, 3, 4 which are driven by a motor 5 and transport a bank note 6 to a stacking wheel assembly 7.

The stacking wheel assembly 7 comprises a stacker wheel 8 having a number of radially outwardly extending tines 9 between which bank notes 6 can be fed from the bank note transport mechanism 1, each pair of tines 9 defining respective banknote receiving slots 9'. The stacker wheel 8 is connected to a drive shaft 10 having an aluminium drive wheel 11 (typically having a diameter of 72 mm).

The stacking wheel assembly 7 is driven by a belt 13 entrained around the drive wheel 11 and a pulley wheel 14 (typically having a diameter of 16 mm) which is driven via a drive shaft 15 by the motor 5. A hub type brake 16 is mounted adjacent to the drive wheel 11 on the stacker wheel assembly 7 to brake drive wheel 11 so as to momentarily stop the rotation of the stacker wheel 8.

A detector system 17 is used to determine the position of a bank note 6 relative to the tines 9 of the stacker wheel 8. The detector system comprises two detectors 19, 20 located between the transport mechanism 1 and the stacker wheel assembly 7 which detect the leading edge of the bank note 6, and a slotted wheel 12 with a light source 21 and detector 22. The wheel 12 rotates with the shaft 10 so that by monitoring the passage of the slots 18 past the detector 22 the positions of the tines 9 at the sheet receiving position 30, can be determined.

Figure 2:
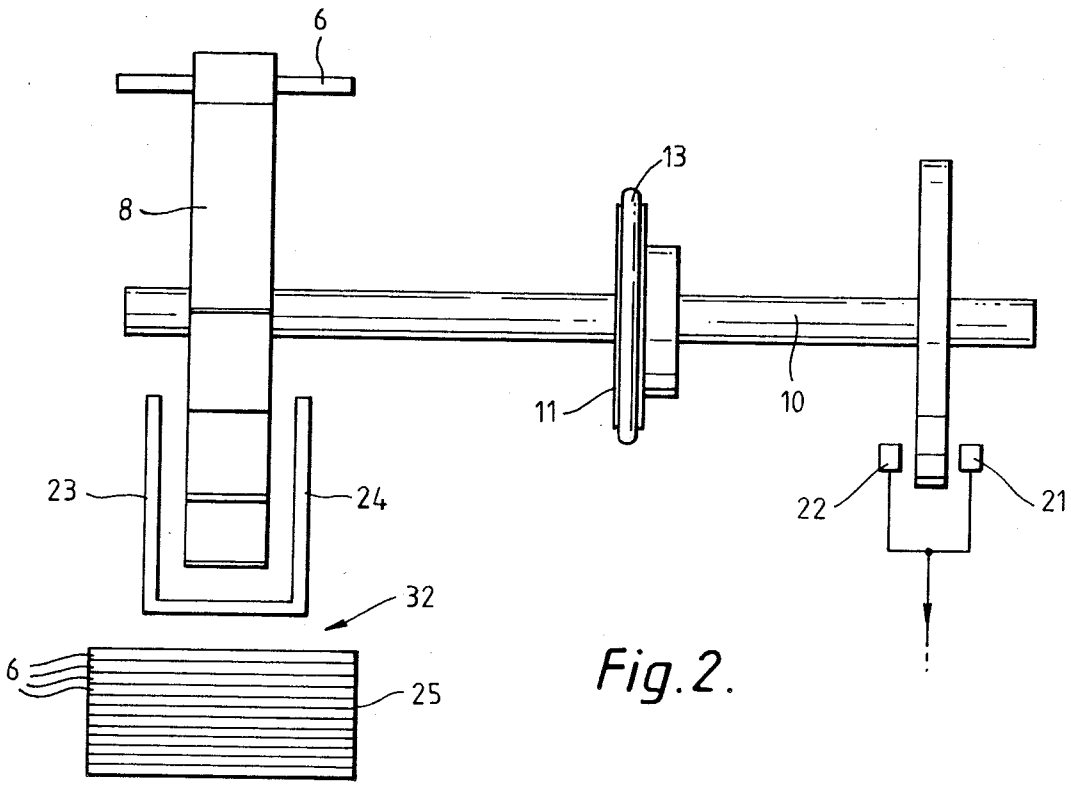

FIG. 2 shows finger stops 23,24 (omitted in FIG. 1) at a sheet stacking position 32 which eject the bank notes 6 from the tines 9 of the stacker wheel 8 as the stacker wheel 8 rotates in the direction of arrow 31.

Typically, the apparatus shown in FIGS. 1 and 2 would be incorporated into a banknote dispensing machine which would further comprise a number of magazines for storing different denominations of currency and a conventional picker mechanism for withdrawing a bank note from a magazine and supplying it to the transport mechanism 1.

In operation the picker mechanism would withdraw a bank note from a magazine and place it on the conveyor belts 2, 3, 4. The bank note 6 would then be transported by the conveyor belts 2, 3, 4 of the transport mechanism 1 to the detectors 19, 20 of the detector system 17. When the leading edge of a bank note is detected by the detectors 19, 20 the detector 22 detects the positions of the tines and from this information, a controlling computer 33 causes a slot 9' to be positioned at the sheet receiving position 30 at the same time as the leading end of the note 6. An electronic signal is then applied to the brake 16 to stop the stacker wheel 8 momentarily so that the leading edge of the bank note 6 can be fed between two of the tines 9.

While the stacking wheel assembly 7 is stopped, the motor 5 is still driving the pulley wheel 14 and therefore the belt 13 acts as a slipping clutch with the belt 13 slipping around the pulley 11.

After the leading edge of the bank note 6 has entered between two of the tines 9 into a slot 9' the brake 16 is released and the stacker wheel 8 continues to rotate and the remainder of the bank note is fed between the tines. As the stacker wheel 8 rotates to bring the bank note to the stacking position the leading edge of the bank note engages against the fingers 23, 24 (see FIG. 2) and is then pushed out of the tines and deposited on the bank note stack 25.

Although the linear speed of the pulley wheel 14 is relatively high (typically 0.3 $ms^{-1}$) we have found that the belt wear on the pulley wheel is not detrimental to satisfactory operation and the life of the drive belt 13 is not adversely affected.

I claim:

1. Sheet feeding apparatus comprising a feed system for feeding sheets, and a sheet stacking system to which said sheets are fed by said feed system, said sheet stacking system including a rotatable stacking wheel having a plurality of sheet receiving slots into which said sheets are fed by said sheet feed system, rotation of said stacking wheel carrying sheets from a sheet receiving position to a sheet stacking position, said sheet stacking system including means actuable to stop the rotation of said sheet stacking system to enable at least the leading end of a sheet to be fed into a sheet receiving slot of said stacking wheel, drive means to rotate said stacking wheel, and a clutch connecting said drive means to said stacking wheel to enable said drive means to continue rotating when said stacking wheel is stopped, wherein said clutch comprises a drive belt entrained around first and second pulley wheels, said first pulley wheel being driven by said drive means and said second pulley wheel being connected to said sheet stacking wheel, said drive belt being adapted to slip around one or both of said pulley wheels when the rotation of said stacking wheel is stopped.

2. Sheet feeding apparatus according to claim 1, wherein rotation of said stacking wheel is stopped by a brake.

3. Sheet feeding apparatus according to claim 1, wherein said drive belt is adapted to slip around said second pulley wheel.

4. Sheet feeding apparatus according to claim 1, wherein both said sheet stacking system and said feed system are driven by the same drive means.

5. Sheet feeding apparatus according to claim 1, wherein said sheet stacking system further comprises stripper means cooperating with said stacking wheel to strip sheets from said sheet receiving slots during rotation of said stacking wheel to said sheet stacking position.

* * * * *